United States Patent [19]

Hulke

[11] 4,295,432

[45] Oct. 20, 1981

[54] HANGING SHELVES

[76] Inventor: Donald B. Hulke, 14254 Ash Cir. Northeast, Prior Lake, Minn. 55372

[21] Appl. No.: 105,512

[22] Filed: Dec. 20, 1979

[51] Int. Cl.[3] ..... A47B 47/06

[52] U.S. Cl. ..... 108/149; 108/111

[58] Field of Search ..... 108/149, 151, 111; D6/113, 134; 182/198, 197, 196; 160/393, 392, 173

[56] References Cited

U.S. PATENT DOCUMENTS

| | | | |
|---|---|---|---|
| D. 247,695 | 4/1978 | Bratton | D6/134 |
| 689,661 | 12/1901 | Triece | 160/393 |
| 1,811,553 | 6/1931 | McElyea | 160/392 |
| 2,652,112 | 9/1953 | Walker | 160/173 |
| 4,122,782 | 10/1978 | Coombs | 108/149 |
| 4,183,439 | 1/1980 | Bell | 211/60 T |
| 4,189,030 | 2/1980 | Leslie et al. | 182/196 |

*Primary Examiner*—Francis K. Zugel

*Attorney, Agent, or Firm*—Kinney, Lange, Braddock, Westman and Fairbairn

[57] ABSTRACT

A hanging shelf includes a shelf having a pair of opposing sides, each having a recess proximate its ends. The recess communicates with a slot along essentially its entire depth, and the slot communicates with the exterior of the shelf. A webbing is inserted into the slot and then into the recess. A plug is inserted into the recess for frictionally holding the webbing against the surface of the recess with sufficient force to hang the shelf from the webbing. An edging member conceals from view the manner in which the webbing is attached to the shelf.

13 Claims, 11 Drawing Figures

Fig. 1
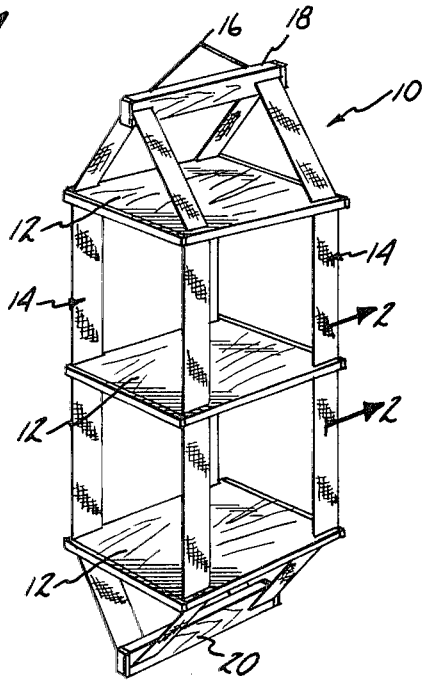
Fig. 2
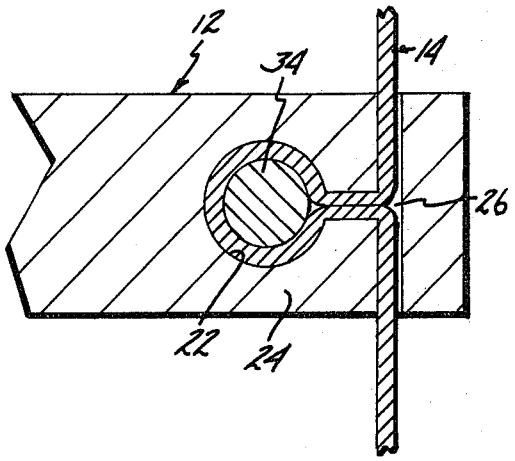
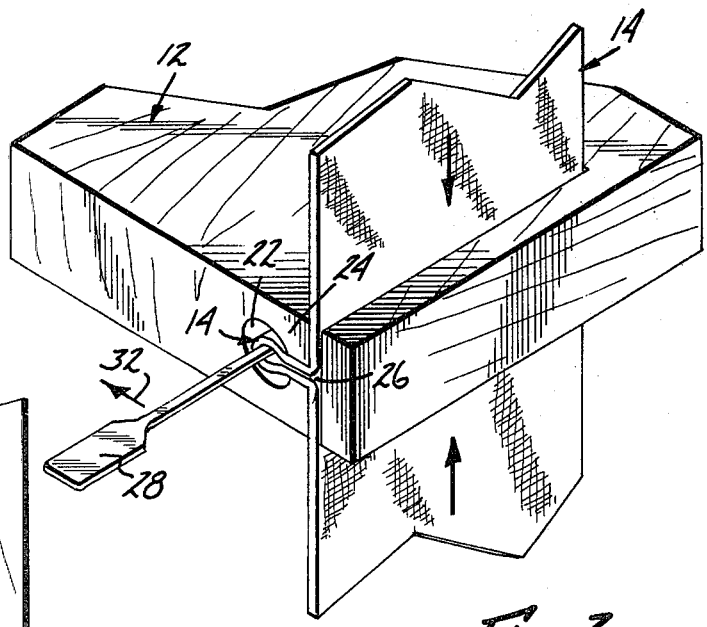
Fig. 3
Fig. 6
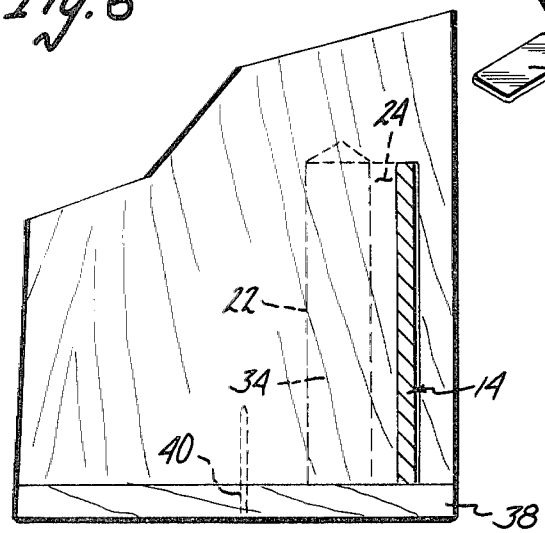

Fig. 4
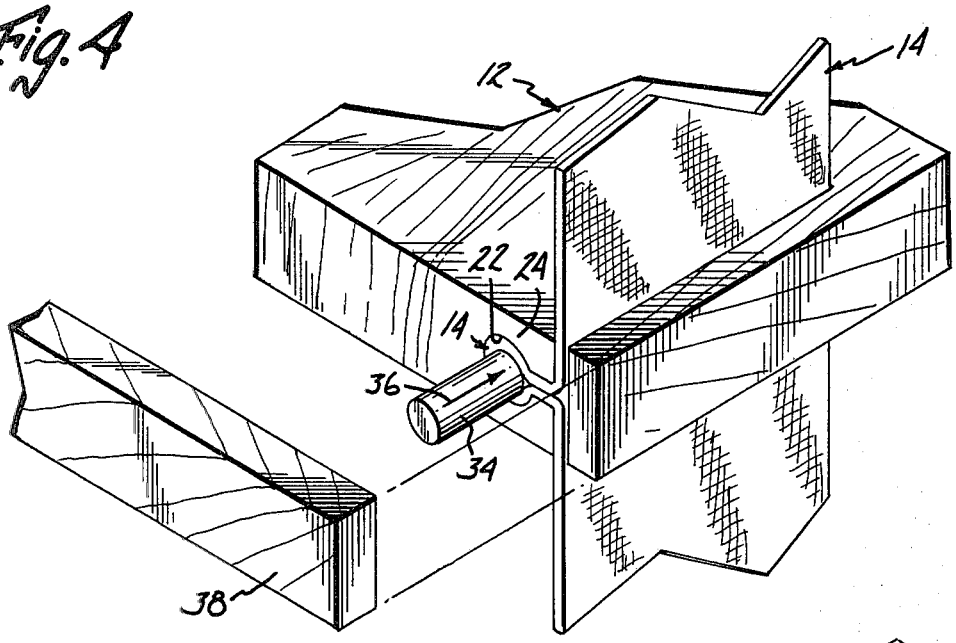
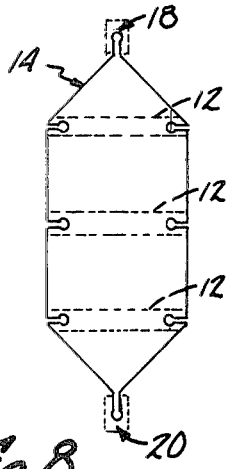
Fig. 8
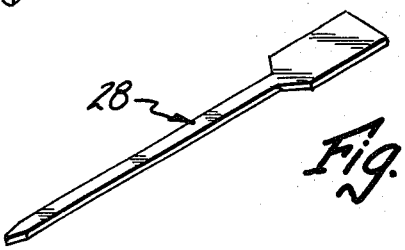
Fig. 5
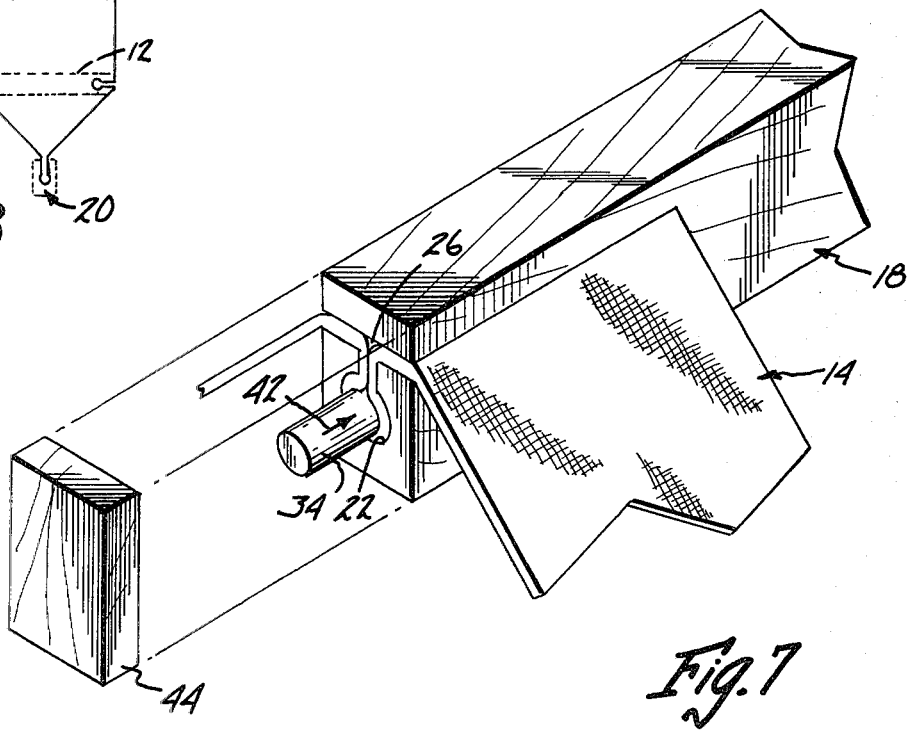
Fig. 7

HANGING SHELVES

BACKGROUND OF THE INVENTION

1. Field of the Invention

The present invention relates to hanging shelves suspended from a webbing, and in particular, the present invention relates to hanging shelves wherein the manner in which the shelf and the webbing are attached is concealed from view.

2. Description of the Prior Art

Hanging shelves suspended from a support directly overhead are useful as space-savers. They do not need floor space as conventional storage devices such as bookshelves. Hanging shelves also may be used away from walls, giving the user a further flexibility that is not found in the typical shelving arrangement which is usually directly attached to a wall. Further, a hanging shelf suspendible from an overhead support gives a room an added dimension when such items as house plants are placed on display on the shelves.

In the prior art, many different shelving arrangements have been proposed. For example, the Andreen U.S. Pat. No. Des. 30,064 shows a hanging shelf arrangement in which the shelves are supported by and spaced vertically from each other by projecting arms projecting from four vertical rods and a center support rod. This type of shelving arrangement is limited because the vertical spacing between the shelves is fixed. Further, this type of shelving would not be aesthetically pleasing in current room decorating themes.

The Slaboden U.S. Pat. No. Des. 230,797 shows a wall shelving arrangement in which the shelves are supported from a flexible belt, the shelves having projections that fit within slots within the belt. Although there is some capability in varying the vertical spacing between the shelves, the spacing is still limited to the existing slots found in the flexible belt. Also, the manner in which the shelves are attached to the belt is in full view which detracts from the aesthetic quality of the shelving arrangement.

The Marks U.S. Pat. No. 2,639,819 teaches a shelving device where the shelves are suspended from each other by rods and enclosed within a thin flexible wall. This device has several shortcomings. First, if the thin flexible wall were to be removed, the shelving arrangement would have little in the way of aesthetics for use as a decorative room shelving arrangement. Second, the vertical spacing between the shelves is set by the length of the rods. Third, the manner in which the shelves are attached to the rods is in full view, which detracts from the aesthetic view point.

The Bratton U.S. Pat. No. Des. 247,695 shows a shelving arrangement which uses an apparently flexible belt to support the shelf. This arrangement has the disadvantage that once the hanging shelves are assembled, the vertical spacing for all practical purposes cannot be changed since the shelves are in some manner fixedly attached to the belt, either by some adhesive or by some type of fastener which punctures the belt leaving a hole in it. Once the belt is punctured and the user wants a different vertical spacing, the punctures in the belt will be in full view.

SUMMARY OF THE INVENTION

The present invention includes a hanging shelf having a shelf with a pair of opposing sides, each side having a recess proximate its ends. The recess communicates with a slot which in turn communicates with the exterior of the shelf. A webbing is inserted into the slot and then into the recess. A plug is inserted within the recess for holding the webbing against the surface of the recess. The plug provides sufficient frictional force to suspend the shelf from the webbing. In preferred embodiments an edging member conceals from view the manner in which the webbing has been inserted into the slot and recess, thereby hiding from the viewer the means of attachment.

BRIEF DESCRIPTION OF THE DRAWINGS

FIG. 1 is a perspective view of the hanging shelves of the present invention.

FIG. 2 is a fragmentary cross-sectional view along the line 2—2 in FIG. 1.

FIG. 3 is a fragmentary perspective view showing the manner in which the web is inserted into the shelf.

FIG. 4 is a fragmentary perspective view partially exploded showing the second step of assembly of the hanging shelves of the present invention.

FIG. 5 is a perspective view of the tool used to insert the belt within the slot and the recess of the present invention.

FIG. 6 is a fragmentary top view of a corner of a shelf completely assembled of the present invention.

FIG. 7 is an exploded fragmentary view showing the manner of assembly of the top end bar of the hanging shelves.

FIG. 8 is a diagrammatic view of a continuous webbing or belt used in the shelving arrangement of the present invention.

DETAILED DESCRIPTION OF THE PREFERRED EMBODIMENTS

The Hanging Shelves of FIGS. 1-8

Figure 9:
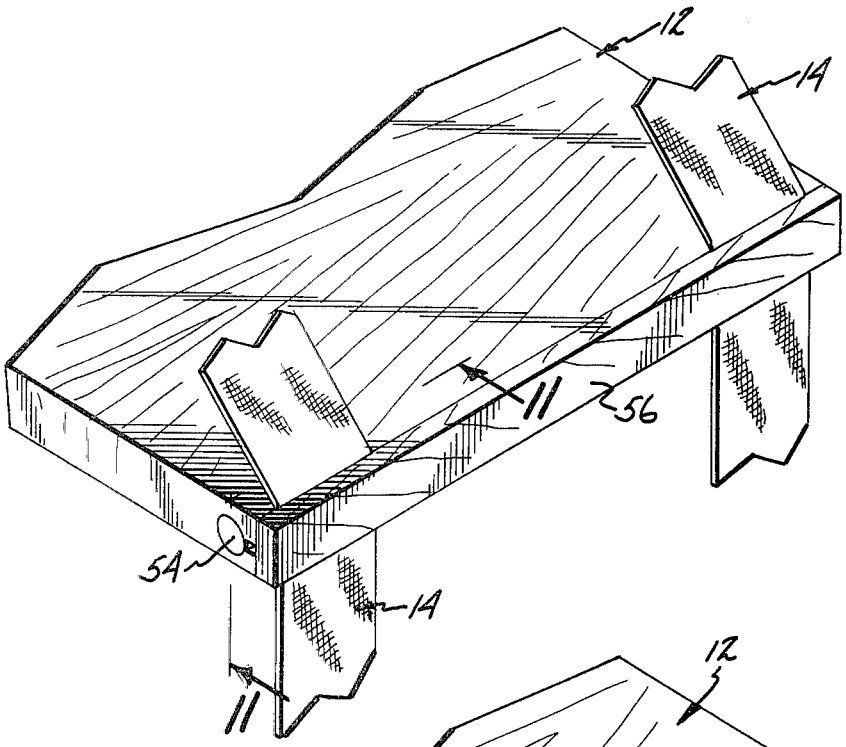
FIG. 9 is a perspective view of another embodiment of the present invention.

FIG. 1 shows a preferred embodiment of the hanging shelf of the present invention generally indicated at 10. The hanging shelves 10 include individual shelves 12 which are supported by flexible webbing or belts 14. In one preferred embodiment, flexible webbing 14 is a fabric such as canvas. The embodiment of FIG. 1 shows three shelves although any number may be used. The embodiment in FIG. 1 further includes an upper end bar 18 and a lower end bar 20 to which the webbing 14 is connected. The hanging shelves 10 may be hung by hanger 16, which is attached to the upper end bar 18, from any support directly overhead.

The manner of attachment of the shelf 12 with the webbing 14 is better shown in FIGS. 2, 3 and 4. The shelf 12 has a recess 22 proximate each end 24 of opposing sides of shelf 12. The recess 22 communicates with a slot 26 along essentially its entire depth. The slot 26 communicates in turn with the exterior of the shelf 12. Both recess 22 and slot 26 have a depth at least the width of webbing 14 as shown in FIGS. 3 and 4. Recess 22 is preferably cylindrical in shape. Slot 26 as shown in FIG. 2 is wide enough to allow webbing 14 to be inserted into slot 26.

The manner of connecting shelves 12 to webbing 14 is best described in the sequence shown in FIGS. 3 and 4. A tool 28, as more fully shown in FIG. 5, is placed within slot 26 and engages webbing 28 in a direction shown by arrow 32. The shape of tool 28 is not critical, so long as it has the ability to pull webbing 14 through slot 26 and into recess 22. Once webbing 14 is pulled within recess 22, plug 34 is forced into recess 22 as indicated by arrow 36 (in FIG. 4) to force webbing 14 against the surface of recess 22. An edging member 38 is preferably fastened against the side displaying plug 34, thereby concealing the manner of attachment from view.

FIG. 6 shows a completely assembled corner of shelf 12. Edging member 38 is held in place by a fastener 40 which is preferably a nail. As can be seen from the above-mentioned Figures, the manner of attachment of webbing 14 to shelf 12 is hidden from view once shelf 12 is assembled. The hidden manner of attachment provides a curious and attractive effect to the hanging shelves of the present invention once assembled. Further, the manner of attachment does not require any special fasteners. A hammer may be used to pound pegs 34 into recess 22 and then to fasten edging member 38 onto the side of shelf 12. Since webbing 14 is never punctured, the vertical spacing between shelf 12 may be varied during assembly to experiment on the vertical spacing desired, or the vertical spacing may be changed at any time in the future. Also, when webbing 14 becomes dirty it may be detached from shelf 12 without any detrimental effects since only frictional forces are used in the attachment.

As shown in FIG. 8, a continuous belt may be used for webbing 14. A continuous belt is an ideal component when the hanging shelves of the present invention are sold in a kit form for the consumer to assemble, because no unsightly ends will be showing upon assembly of the hanging shelves of the present invention.

FIG. 7 shows a preferred embodiment of upper end bar 18 in an exploded view. The upper end bar 18 is attached to webbing 14 in a similar manner as has been described previously with regard to shelf 12. Webbing 14 is inserted into slot 26 and then drawn into recess 22 by using tool 28. Plug 34 is forced into recess 22 as shown by arrow 42, thus holding webbing 14 against the surface of recess 22. An edge member 44 is attached to the end of the upper end bar 18 to conceal the manner in which webbing 14 is attached to upper end bar 18. Lower end bar 20 is attached to webbing 14 in a similar manner.

Figure 10:
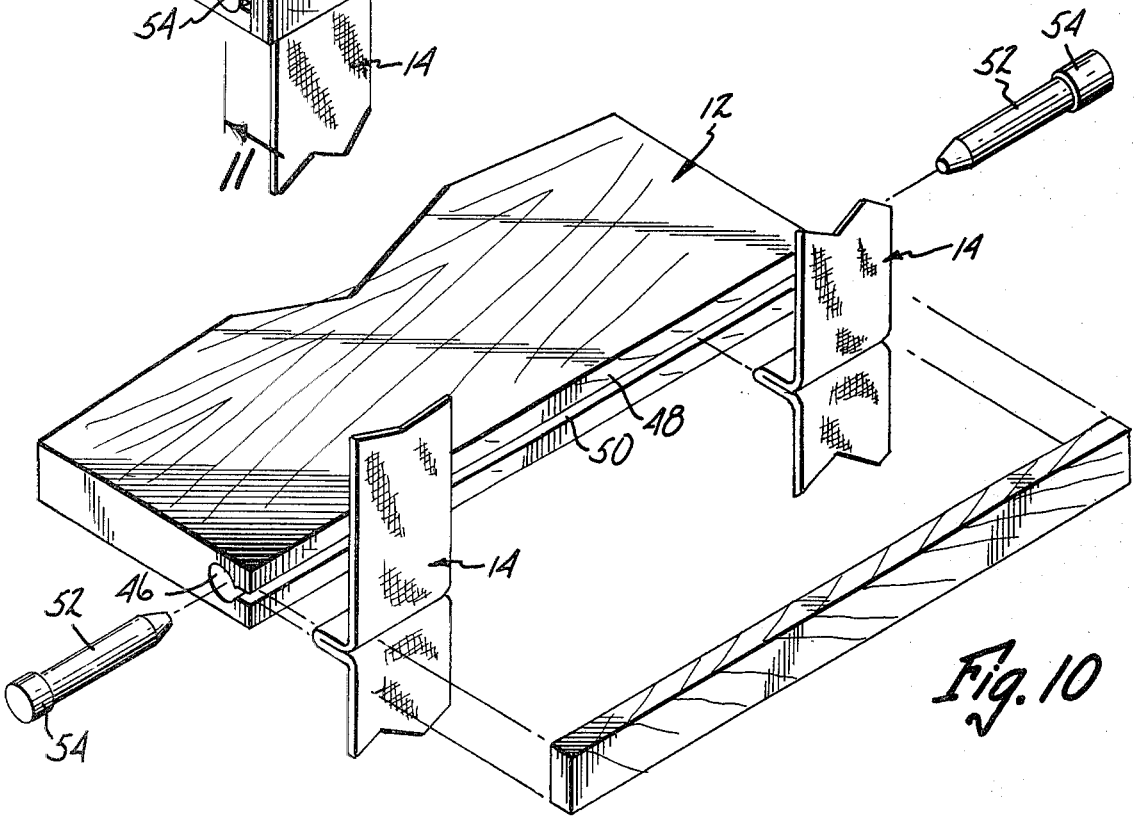
FIG. 10 is a perspective view exploded of the embodiment in FIG. 9.
Figure 11:
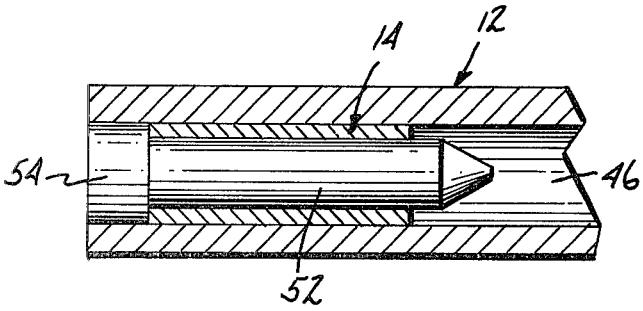
FIG. 11 is a cross-sectional view taken along line 11—11 in FIG. 9.

The Hanging Shelves of FIGS. 9–11

FIGS. 9 through 11 show another embodiment of the hanging shelves of the present invention. In the embodiment of FIGS. 9–11 a recess 46 projects along the entire side 48 of shelf 12. A slot 50 communicates with recess 46 along its entire length and communicates with the exterior of shelf 12 along side 48. The webbing 14 is inserted into slot 50 and then into recess 46 in a similar manner as described previously. Pegs 52 are inserted into recess 46 and hold the webbing in frictional engagement against the surfaces of the recess. In the specific embodiment shown in FIGS. 10 and 11, pegs 52 have shoulders 54 that hide the edge of the webbing from external view, as best seen in FIG. 11. An edging member 56 is then fastened against side 48 preferably with a hammer and nail type fastener. The edging member 56 conceals from view the manner of attachment and provides the same effect as the other embodiments of the present invention previously described, as best seen in FIG. 9.

CONCLUSION

The hanging shelves of the present invention may be sold in a disassembled state in kit form or in assembled state. The hanging shelves are easily put together by the user, allowing experimentation in the vertical spacing desired without any detrimental effect since frictional forces rather than staples, nails or glue hold together the webbing and the shelves. Since the manner of attachment is hidden, the hanging shelves of the present invention provide an aesthetic quality current with modern decoration themes and provide a curious effect as to how the shelves are attached to the webbing.

Although the present invention has been described with reference to the preferred embodiments, persons skilled in the art will recognize that changes, such as the manner of concealing the method of attachment of the web and shelf, may be made in form and detail without departing from the spirit and scope of the invention.

I claim:

1. A hanging shelf apparatus comprising:

webbing means;

a shelf having a pair of opposing sides and an upper and a lower surface, each side having a recess proximate both ends with a depth equal to at least the width of the webbing means and a slot with a length approximately equal to the width of the webbing means communicating with and along each recess and communicating with the upper and the lower surface of the shelf, the slot and the recess being positioned to receive and hold the webbing means such that the webbing means extends through the upper and lower surfaces; and recess engaging plug means having a width sufficient for frictionally engaging the webbing means against a surface of the recess to connect the webbing means and the shelf.

2. The hanging apparatus of claim 1 and further comprising an edging member attached to the ends of the shelf for concealing the recess engaging plug means.

3. The hanging shelf apparatus of claim 1 wherein the webbing means are two flexible belts.

4. The hanging shelf apparatus of claim 3 wherein the flexible belts are continuous.

5. The hanging shelf apparatus of claim 1 and further comprising a plurality of spaced apart shelves suspended from and attached to the webbing means.

6. The hanging shelf apparatus of claim 1 wherein the recess is cylindrical in shape.

7. The hanging shelf apparatus of claim 6 wherein the recess engaging plug means is cylindrical in shape.

8. The hanging shelf apparatus of claim 1 and further comprising:

an end bar having a slot and a recess at each end with a depth equal to at least the width of the webbing, said slot communicating with the recess along the entire length of said depth and said slot communicating with the exterior surface of the bar, the webbing means being insertable within the recess and the slot; and recess engaging plug means engaging the recess and holding the webbing means against the surface of the recess with sufficient frictional force to hold the webbing means in a fixed position with respect to the bar.

9. The hanging shelf apparatus of claim 8 and further comprising:

an end cap fixedly attached to each end to conceal from view the manner in which the webbing is attached to the bar.

10. A hanging shelf apparatus comprising:

webbing means;

a plurality of shelves, each shelf having a pair of opposing sides and an upper and a lower surface, each side of each shelf having a recess proximate both ends with a depth equal to at least the width of the webbing means and a slot with a length approximately equal to the width of the webbing means communicating with and along each recess and communicating with the upper and the lower surfaces of each shelf, the slot and the recess being positioned to receive and hold the webbing means such that the webbing means extends through the upper and lower surfaces; and recess engaging plug means having a width sufficient to frictionally engage the webbing means against a surface of the recess to connect the webbing means to each shelf and to connect all the shelves to each other in a substantially horizontal spaced relationship.

11. The hanging shelf apparatus of claim 10 and further comprising:

an end bar having a slot and a recess at each end with a depth equal to at least the width of the webbing, said slot communicating with the recess along the entire length of said depth and said slot communicating with the exterior surface of the bar, the webbing means being insertable within the recess and the slot; and recess engaging plug means engaging the recess and holding the webbing means against the surface of the recess with sufficient frictional force to hold the webbing means in a fixed position with respect to the bar.

12. The hanging shelf apparatus of claim 11 and further comprising:

an end cap fixedly attached to each end to conceal from view the manner in which the webbing is attached to the bar.

13. A hanging shelf apparatus comprising:

webbing means including a first, a second, a third, and a fourth flexible generally vertical web, the webs being spaced apart from and substantially parallel to each other;

a plurality of shelves, each shelf having an upper and a lower surface, a first and a second side and a first and a second end, a frist and a second recess positioned within the first end and a third and a fourth recess positioned within the second end, the recesses being spaced from and generally parallel to the sides, a first, a second, a third, and a fourth slot, each slot communicating with both the upper and the lower surface and the first, the second, the third, and the fourth recess, respectively, and spaced generally parallel from the first and the second side, the slots and the recesses having a depth approximately equal to the width of the web and each slot and recess receiving one of the webs;

a first, a second, a third, and a fourth recess engaging plug having a width sufficient for frictionally engaging the first, the second, the third, and the fourth web, respectively, against a surface in the corresponding recess to connect each web to each shelf; and a first and a second edging member attached to the first and the second end, respectively, for concealing each of the recesses and each of the plugs.

* * * * *